United States Patent [19]

Albertson

[11] 4,446,006

[45] May 1, 1984

[54] ARSENIC REMOVAL FROM HYDROCARBONS

[75] Inventor: Walter Albertson, Brea, Calif.

[73] Assignee: Union Oil Company of California, Los Angeles, Calif.

[21] Appl. No.: 377,615

[22] Filed: May 13, 1982

[51] Int. Cl.[3] ..... C10G 29/06

[52] U.S. Cl. ..... 208/253; 208/251 R

[58] Field of Search ..... 208/251 R, 253

[56] References Cited

U.S. PATENT DOCUMENTS

| | | | |
|---|---|---|---|
| 2,411,958 | 12/1946 | Dietrich et al. . | |
| 2,411,959 | 12/1946 | Dietrich et al. . | |
| 2,683,683 | 7/1954 | Mills . | |
| 2,778,777 | 1/1957 | Powell . | |
| 2,779,715 | 1/1957 | Murray et al. . | |
| 2,854,399 | 9/1958 | Weller . | |
| 2,867,577 | 1/1959 | Urban, Jr. et al. . | |
| 2,926,129 | 2/1960 | Kimberlin, Jr. et al. . | |
| 2,969,320 | 1/1961 | Shapiro et al. . | |
| 3,303,126 | 2/1967 | Gleim . | |
| 3,511,774 | 5/1970 | Long et al. . | |
| 3,562,151 | 2/1971 | Langlois et al. . | |
| 3,849,297 | 11/1974 | Long . | |
| 4,029,571 | 6/1977 | Curtin | 208/251 R |
| 4,046,674 | 9/1977 | Young . | |
| 4,075,085 | 2/1978 | Young . | |
| 4,142,912 | 3/1979 | Young . | |
| 4,233,138 | 11/1980 | Rollmann et al. . | |

FOREIGN PATENT DOCUMENTS

| | | | |
|---|---|---|---|
| 529649 | 8/1956 | Canada | 208/253 |

OTHER PUBLICATIONS

Cotton and Wilkinson, "The Group V Elements: P, As, Sb, Bi–Sulfides" in *Advanced Inorganic Chemistry,* 1966, pp. 501–502, Interscience Publishers.

*Hackh's Chemical Dictionary,* "Heavy–Metal" and Arsenic, pp. 315, 61, McGraw–Hill Book Co. 4th Ed.

"Reactions of Metalloporphyrins and Petroporphyrins with $H_2S$ and $H_2$" Rankel, the Division of Petroleum Chemistry, Inc., American Chemical Society, New York Meeting, Aug. 23–28, 1981.

"How are Kings and Marine Algae Alike?" by West set forth in *Science News,* vol. 115, No. 12, p. 189 (Mar. 24, 1979).

*Primary Examiner*—Delbert E. Gantz

*Assistant Examiner*—Lance Johnson

*Attorney, Agent, or Firm*—Gregory F. Wirzbicki; Dean Sandford

[57] ABSTRACT

Elemental sulfur or aqueous sodium hydrogen phosphate is added to an arsenic-containing hydrocarbon, yielding a product hydrocarbon of reduced arsenic content. The process of the invention is particularly useful in the treatment of shale oils and other syncrudes containing relatively large concentrations of arsenic.

19 Claims, No Drawings

ARSENIC REMOVAL FROM HYDROCARBONS

BACKGROUND OF THE INVENTION

This invention relates to the refining or upgrading of hydrocarbons containing arsenic, and is most particularly related to the removal or arsenic from hydrocarbon liquids, especially from shale oils or fractions derived therefrom.

Metals contained in crude oils, residual fractions, and the like present difficulties in refining or upgrading to more valuable products, such as gasoline, turbine fuel, etc. Most metals, for example, vanadium and nickel, and to lesser extent iron and copper, deactivate a variety of refining catalysts, and, as a result, processes generically termed "demetallization" or "demetallation" have been proposed for removing deleterious metals from hydrocarbons prior to the catalytic refining thereof. In some of these processes, the hydrocarbon contaminated with metals is treated with a sulfur-containing agent. For example, as disclosed in U.S. Pat. No. 2,683,683, sulfiding agents, such as hydrogen sulfide and ammonical hydrogen sulfide, are reacted with the heavy metal components of a hydrocarbon fraction to produce insoluble heavy metal sulfides, the sulfides then being removed by filtration, electrostatic separation, etc. In another process, described more fully in U.S. Pat. No. 2,854,399, heavy metals are removed by passage of the contaminated hydrocarbon through a bed of solid, elemental sulfur. And in yet another process, dilute sulfuric acid is employed, as disclosed in U.S. Pat. No. 2,778,777, to convert heavy metal constituents in a hydrocarbon to water-soluble forms which are then removed by washing with water.

In addition to vanadium, nickel, and other metals, it is often desirable to remove arsenic from hydrocarbons, particularly with respect to shale oils and fractions derived therefrom. Raw shale oil produced by retorting oil shale from the Green River area of Utah, Colorado, and Wyoming, which oil shale is often termed "Colorado oil shale," usually contains arsenic components in concentrations ranging between about 20 and 80 wppm (calculated as arsenic). In order to upgrade shale oils containing arsenic in such relatively large concentrations, it is a virtual necessity for the oil to be purified of arsenic, the deactivation effects of arsenic on many refining catalysts, especially hydrotreating catalysts, being well known. Accordingly, processes have been developed for removing arsenic from hydrocarbons, and particularly from shale oils and the like. An exemplary process, disclosed in U.S. Pat. No. 4,046,674, employs a catalytic absorbent for this purpose. In another process, disclosed in U.S. Pat. No. 4,075,085, arsenic is removed from hydrocarbons after heating in the presence of oil-soluble nickel, cobalt, or copper additives.

There is, therefore, an ongoing effort being made in the art to remove arsenic from shale oils and the like. Accordingly, it is an object of the present invention to provide a process for reducing the concentration of arsenic in shale oil and other arsenic-containing hydrocarbons. Other objects and advantages will appear to those skilled in the art from the following description of the invention.

SUMMARY OF THE INVENTION

In accordance with the present invention, a process is provided for reducing the arsenic content of arsenic-containing hydrocarbons, the process comprising contacting an arsenic-containing hydrocarbon with elemental sulfur or aqueous sodium hydrogen phosphate, and removing arsenic components so as to yield a product hydrocarbon of reduced arsenic content. In the preferred embodiment of the invention, the arsenic-containing hydrocarbon is contacted with a combination of elemental sulfur and aqueous sodium hydrogen phosphate, following which arsenic components are separated and removed from a product hydrocarbon of reduced arsenic content.

DETAILED DESCRIPTION OF THE INVENTION

The process of the present invention is directed to reducing the arsenic content of arsenic-containing hydrocarbons. The invention, therefore, is applicable to the treatment of crude oils or fractions thereof containing arsenic, especially in concentrations of at least 2 wppm. The process is effective for treatment of hydrocarbons such as synthetic crudes (syncrudes) or fractions thereof obtained from arsenic-containing oil shale, coal, and tar sand. Arsenic concentrations in these hydrocarbons often exceed 20 wppm, with values typically ranging from 20 to 80 wppm for full range shale oil derived from Colorado oil shale, and from 20 to 1200 wppm for many coal tar distillates. The process is highly effective for treating full range Colorado shale oils and fractions thereof containing between about 20 and about 80 wppm arsenic, and producing therefrom a product hydrocarbon of reduced arsenic content.

It will be understood that the terms "arsenic" and "arsenic components" as used herein include arsenic in whatever forms, elemental or combined, it may be present. Also, all concentrations of arsenic in hydrocarbons are herein calculated by weight as elemental arsenic. It will also be understood that the terms "arsenic-containing hydrocarbon" and "product hydrocarbon" as used herein refer to the starting and product materials, respectively. These materials may contain one hydrocarbon or a mixture thereof, with the most usual embodiment of the invention being directed to the treatment of mixed hydrocarbons containing arsenic in organic and/or inorganic forms.

In one embodiment of the invention, an arsenic-containing hydrocarbon is contacted with elemental sulfur, as by blending powdered sulfur or flowers of sulfur therewith. The blending may be accomplished in a suitable reactor vessel, such as a batch or flow reactor, wherein a reaction zone is conveniently maintained. Typically, agitating conditions are maintained in the reaction zone, and the sulfur and arsenic-containing hydrocarbon are introduced at rates such that 0.01 to 0.50 pounds, preferably 0.05 to 0.35 pounds, of sulfur are introduced per pound of feed. Reaction conditions are not critical; conditions of atmospheric pressure and ambient temperature, for example, have proven highly useful. But if desired, elevated pressures and/or elevated temperatures may be employed, often with improved results. As an illustration, the data obtained from the experiments described hereinafter in the Example indicate that, under otherwise similar reaction conditions, elemental sulfur is effective for removing over 75 percent of the arsenic in a full range Colorado shale oil at reaction temperatures between about 85° C. (185° F.) and about 150° C. (302° F.) compared to about 55 percent at ambient temperature. Usually, however, temperatures above about 121° C. (250° F.) are avoided, as higher temperatures often significantly increase the sulfur content of the product hydrocarbon due to sulfur-hydrocarbon chemical reactions.

In an alternative embodiment of the invention, arsenic is removed from shale oil or other arsenic-containing hydrocarbon by contact with aqueous sodium hydrogen phosphate, with the contacting usually being achieved by forming an intimate admixture of the aqueous sodium hydrogen phosphate and the arsenic-containing hydrocarbon to be treated. In yet another embodiment of the invention, which is the preferred embodiment, both aqueous sodium hydrogen phosphate and elemental sulfur are blended with the arsenic-containing hydrocarbon, either in individual stages or, as is more preferred, in a single reaction vessel wherein the arsenic-containing hydrocarbon, the elemental sulfur, and the sodium hydrogen phosphate dissolved in an aqueous medium are in mutual contact.

The sodium hydrogen phosphate may be either sodium monohydrogen phosphate or sodium dihydrogen phosphate, or the two in combination, but the presence of sodium monohydrogen phosphate in the aqueous medium is preferred. Typically, the sodium hydrogen phosphate is employed in an aqueous solution in an amount such that the phosphate content is at least 0.10 molar, and preferably between about 0.5 and 2.5 molar. The solution is blended with the arsenic-containing hydrocarbon in a solution-to-hydrocarbon volumetric ratio usually above about 0.1:1.0, preferably between about 0.5:1.0 and 1.5:1.0. The use of aqueous sodium hydrogen phosphate often significantly increases the amount of arsenic removed, by at least ten percent in most instances, and by more than fifty percent under favorable conditions. The extent of the improvement in any given situation, however, will depend not only upon the use of aqueous sodium hydrogen phosphate, but also on the amount used, the nature of the arsenic-containing hydrocarbon feed, the reaction conditions, etc.

After contact of elemental sulfur, aqueous sodium hydrogen phosphate, or a combination thereof with the arsenic-containing hydrocarbon in the batch reactor or other reaction vessel, and for a sufficient time period, e.g., for residence times of 15 minutes to two hours, an effluent is recovered, from which are separated arsenic components and a product hydrocarbon of reduced arsenic content. Any of a variety of separation means may be utilized. To separate arsenic components present in solid form, equipment such as filters, centrifuges, and the like are suitable; to remove water-soluble arsenic components, an aqueous liquid extractant is usually employed. The extractant may be contacted with the effluent from the reaction vessel, or introduced directly into the reaction vessel, and in the latter case, the use of aqueous sodium hydrogen phosphate is preferred, serving simultaneously as an agent for converting all or a portion of the arsenic to water-soluble forms, and as an extractant for dissolving water-soluble arsenic components. In the usual instance, the extraction is accomplished under conditions of ambient temperature and atmospheric pressure and with a volumetric ratio of extractant to total hydrocarbons above about 0.1:1.0, preferably between about 0.5:1.0 and 1.5:1.0. Following extraction, the aqueous extractant, now relatively rich in arsenic components, is separated from the hydrocarbons commingled therewith, using, for example, a centrifuge, or other conventional liquid-liquid separators which take advantage of the density differences and immiscibility of hydrocarbons and water. Included among such liquid-liquid separators are knock-out drums of sufficient size to allow a hydrocarbon-aqueous mixture to settle into two or more liquid phases. Usually, only two phases are separated, one hydrocarbonaceous, the other aqueous, but on occasion, as when the hydrocarbon feedstock contains relatively heavy components having densities greater than water, three phases are obtained, with the aqueous phase forming between the relatively heavy and the relatively light hydrocarbons.

If desired, the separation of the product hydrocarbon from arsenic components may be accomplished in one or more stages, that is, the effluent from the reaction vessel may be treated in one or more solid-liquid separators and/or with one or more liquid extractants followed by separation in one or more liquid-liquid separators. For example, in the preferred embodiment of the invention, wherein aqueous sodium hydrogen phosphate and elemental sulfur in combination are contacted with the arsenic-containing hydrocarbon in a reaction zone, the effluent thereof is entirely subjected to filtration to remove suspended arsenic components, following which the resultant hydrocarbon-aqueous liquid mixture is passed to a suitable knock-out drum for separation and recovery of the product hydrocarbon. Alternatively, but less preferably, the effluent from the reaction zone may first be passed to a liquid-liquid separator, followed by filtering or centrifuging solid arsenic components, thus yielding the desired product hydrocarbon.

Depending upon the separation method employed, arsenic components are removed from the hydrocarbon feed in solid and/or liquid forms. If solid-liquid separation equipment is used, then arsenic components together with elemental sulfur are generally recovered in a solids admixture, with some of the arsenic components believed to be in one or more forms of arsenic sulfide. If liquid-liquid separation equipment is employed, then arsenic components are recovered in dissolved form in an aqueous extractant. And in the preferred embodiment, wherein both solid-liquid and liquid-liquid separators are employed, then the resultant arsenic components will be removed from the hydrocarbon in both solid and liquid forms.

When solid-liquid separation equipment is employed with recovery of a solids-solids admixture of arsenic components and elemental sulfur, the elemental sulfur may be separated from the arsenic components by raising the temperature of the admixture in a suitable vessel above the melting point of sulfur, e.g., 260° F. (127° C.), and then removing solid arsenic components from either liquid and/or vaporous sulfur. In this manner, there is obtained both a solid material that is highly concentrated in arsenic components and an elemental sulfur product containing either no arsenic or only a relatively small proportion thereof. This sulfur product may then be recycled to the reaction zone as a source of elemental sulfur, while the arsenic components remain for collection in the form of said solid material, which is relatively arsenic-rich in comparison to the original solids-solids, arsenic-sulfur admixture.

In the usual instance, the arsenic components removed from the hydrocarbon feed, whether in liquid or solid form, are considered a waste material, and in the preferred embodiment of the invention, these arsenic components are treated for waste disposal, as for example, by the method disclosed in U.S. Pat. No. 4,142,912, herein incorporated by reference in its entirety. This patent teaches a method for treating arsenic-containing waste materials by admixture with Portland cement, water, and one or more water-soluble manganese or alkaline earth metal salts so as to produce, after curing, a landfill material highly impervious to the arsenic-leaching effects of rain waters, ground waters, and the like.

Concomitant with the removal of arsenic components in solid or liquid form, along with the optional but preferred recovery of elemental sulfur, one or more hydrocarbon liquid phases are obtained, the totality of which are herein considered the product hydrocarbon. This product hydrocarbon is of substantially reduced arsenic content in comparison to the arsenic-containing hydrocarbon feed, the arsenic reductions often exceeding 50 percent, and even 75 percent. In addition, a significant reduction in ash and/or contaminant metals, such as vanadium, copper, iron, nickel, etc., which may have been present with the arsenic in the feed, will be realized, and the use of an aqueous extractant, as in the preferred embodiment, will effect removal of water-soluble constituents originally present in the arsenic-containing hydrocarbon. In addition, when elemental sulfur is employed in the reaction zone, the sulfur content of the product hydrocarbon may be increased somewhat over that of the feed. But in other respects, the characteristics and properties of the product hydrocarbon will be substantially similar to those of the original arsenic-containing hydrocarbon, assuming, of course, that the conditions maintained in the reaction zone, and particularly the operating temperature therein, are not so severe as to cause hydrocarbon cracking, or hydrocarbon-sulfur reactions, or other hydrocarbon conversion reactions to a significant extent. In general, provided the operating temperature in the reaction zone is maintained below about 250° F. (121° C.), and preferably below about 200° F. (93.3° C.), the product hydrocarbon will be found to have the same or essentially similar characteristics as the arsenic-containing hydrocarbon feedstock from which it was derived. Thus, the gravity, viscosity, pour point, sulfur content, etc., of the hydrocarbon feedstock will not usually be substantially affected by the treatment in the process of the present invention.

In the following Examples, a preferred method for practicing the process of the present invention and a comparison illustrating the efficacy of the invention are presented. The Examples, however, are not intended to limit the invention, which is defined by the claims.

EXAMPLE I

A full range shale oil obtained from a Colorado oil shale contains 50 wppm arsenic. In accordance with the invention, the shale oil is introduced into a reactor vessel along with elemental sulfur and an aqueous solution of sodium monohydrogen phosphate having a 2.0 molar phosphate content (due only to the dissolved sodium hydrogen phosphate). The sulfur is added to the reaction vessel at a rate of 0.30 pounds per pound of shale oil while the aqueous sodium monohydrogen phosphate solution is added at the rate of 1.0 volume per volume of shale oil. The reaction is conducted at ambient temperature and atmospheric pressure.

Withdrawn from the reactor vessel is an admixture containing sulfur, solid arsenic components, and two liquid phases, one aqueous, the other hydrocarbonaceous. The admixture is first passed to a filter, wherefrom a solids-solids admixture of elemental sulfur and arsenic components is obtained. The filtrate, containing the two liquid phases, is passed to a knock-out drum and therein separated into an aqueous liquid containing arsenic components and a product hydrocarbon of substantially reduced arsenic content in comparison to the original shale oil. The product hydrocarbon has similar gravity, viscosity, pour point, etc., as the original shale oil.

If desired, the solids-solids admixture may be separated into a solid of relatively high arsenic concentration and elemental sulfur for recycle to the reactor vessel. This may be accomplished by introducing the solids-solids admixture into a vessel wherein the temperature is raised sufficiently to vaporize elemental sulfur, which is then removed from the reaction vessel and condensed in a shell-and-tube condenser. The solid material left behind in the vessel will be highly concentrated in arsenic and is in a form most easily converted to a landfill material in accordance with the method disclosed in U.S. Pat No. 4,142,912.

EXAMPLE II

A series of experiments is performed to evaluate the effectiveness of various additives for reducing the arsenic content of a raw, full range shale oil obtained from a Colorado oil shale containing about 42 gallons per ton of oil. The raw shale oil is found by appropriate analytical techniques to contain about 0.963 wt. % sulfur, 0.05 wt. % ash, and between about 49 and 51 wppm arsenic. The arsenic in the shale oil is known to be in dissolved form, because filtration or centrifuging of the shale oil does not result in any arsenic reduction.

Each of the experiments will now be briefly described; a summary of the results obtained from the experiments is presented thereafter in Table I.

EXPERIMENT A

In this experiment, 15 grams of unhydrated sodium monohydrogen phosphate in solid form is admixed with 50 milliliters of shale oil. After filtration, the product hydrocarbon contains 51 wppm arsenic, indicating no reduction in arsenic content.

EXPERIMENT B

In this experiment, 20.1 grams of elemental sulfur are admixed with 50 milliliters of shale oil, and the resultant mixture is heated to 80° C. (176° F.) and held at that temperature for 30 minutes. After centrifuging and filtering, the product hydrocarbon is found to contain only 0.01 wt. % ash and 20 wppm arsenic, indicative of a 59.2 percent removal of arsenic. The product hydrocarbon is also found to contain 4.13 wt. % sulfur.

EXPERIMENT C

In this experiment, 15.1 grams of elemental sulfur and 15.0 grams of unhydrated sodium monohydrogen phosphate dissolved in 50 milliliters of water are admixed under ambient conditions with 50 milliliters of shale oil. After centrifuging, the product hydrocarbon is found to contain 9.4 wppm arsenic, indicative of an 80.8 percent reduction in arsenic content.

EXPERIMENT D

In this experiment, 15.0 grams of monohydrated sodium dihydrogen phosphate is admixed with 50 milliliters of shale oil under ambient conditions. The product hydrocarbon, obtained after filtration, contains 50 wppm arsenic; no arsenic is therefore removed.

EXPERIMENT E

In this experiment, 15.0 grams of unhydrated sodium monohydrogen phosphate dissolved in 50 milliliters of water are admixed with 50 milliliters of shale oil, and two analyses of the product hydrocarbon obtained after centrifuging determine arsenic values of 34 and 36 wppm, indicating an arsenic removal between 26.5 and 30.6 percent.

EXPERIMENT F

In this experiment, 15 grams of monohydrated sodium dihydrogen phosphate dissolved in 50 milliliters of water is admixed with 50 milliliters of shale oil. The resultant mixture is heated to 95° C. (203° F.) and held at that temperature for about 45 minutes. After centrifuging, the hydrocarbon product is found to contain 38 wppm arsenic, indicating a 22.4 percent reduction in arsenic content.

EXPERIMENT G

In this experiment, 30 grams of unhydrated trisodium phosphate dissolved in 50 milliliters of water is admixed under ambient conditions with 50 milliliters of shale oil. After centrifuging to separate the aqueous and hydrocarbonaceous phases, the product hydrocarbon phase is found to contain 48 wppm arsenic, indicating essentially no reduction in arsenic content.

EXPERIMENT H

In this experiment, 30 grams of elemental sulfur are blended under ambient conditions with 50 milliliters of shale oil. After filtration, the product hydrocarbon is found to contain 0.02 wt. % ash and 22 wppm arsenic, indicative of a 55.1 percent reduction of arsenic. The product hydrocarbon is also found to contain 2.58 wt. % sulfur.

EXPERIMENT I

In this experiment, 30 grams of elemental sulfur are blended with 50 milliliters of raw shale oil, and the resultant mixture is held at 150° C. (302° F.) for 5 minutes. After filtration, the product hydrocarbon contains 0.01 wt. % ash and 5.5 wppm arsenic, indicative of an 88.8 percent arsenic reduction. The product hydrocarbon is also found to contain 20.8 wt. % elemental sulfur.

EXPERIMENT J

In this experiment, 30 grams of elemental sulfur are mixed with 50 milliliters of shale oil, and the temperature of the mixture is raised to 90° C. (194° F.) and held for about 5 minutes. After filtration, the product hydrocarbon contains 7.0 wppm arsenic, indicating an 85.7 percent reduction in arsenic content.

EXPERIMENT K

In this experiment, 30 grams of unhydrated sodium monohydrogen phosphate dissolved in 50 milliliters of water is admixed with 50 milliliters of shale oil, and the temperature of the admixture is raised to 96° C. (204.8° F.) and held for two minutes at that temperature, and then lowered to 90° C. (194° F.) and held for about 30 minutes at that temperature. After centrifuging, the product hydrocarbon is found to contain 36 wppm arsenic, indicative of a 26.5 percent arsenic reduction.

EXPERIMENT L

In this experiment, 5.5 grams of monohydrated sodium monohydrogen phosphate dissolved in 50 milliliters of water is admixed with 50 milliliters of shale oil, and the resulting mixture is heated to between about 90° and 100° C. (194° to 212° F.) and held at that temperature for 30 minutes. Analytical results after centrifuging alone and after centrifuging followed by filtration indicate that the arsenic content of the product hydrocarbon is between about 35 and 38 wppm, indicative of between a 22.4 and 28.6 percent removal of arsenic.

In the following Table I are tabulated data obtained from the foregoing Experiments A through L inclusive. For ease in correlation with the previous descriptions of the experiments, each value presented in Table I is followed in parentheses by the letter designation of the experiment from which the value was derived.

TABLE I

PERCENT REMOVAL OF ARSENIC FROM SHALE OIL[1]

| | Reaction Temperature | | | |
|---|---|---|---|---|
| Additive | Ambient | 80° C. | 90°-100° C. | 150° C. |
| Rhombic Elemental Sulfur, Fine Powder | 55.1(H) | 59.2(B) | 85.7(J) | 88.8(I) |
| Rhombic Elemental Sulfur, Fine Powder + Aqueous $Na_2HPO_4$ | 80.8(C) | | | |
| Aqueous $Na_2HPO_4$ | 28.6-30.6(E) | | 26.5(K) | |
| Aqueous $Na_2HPO_4.H_2O$ | | | 22.4-28.6(L) | |
| Aqueous $Na_3PO_4$ | 0(G) | | | |
| Aqueous $NaH_2PO_4.H_2O$ | | | 22.4(F) | |
| Dry $Na_2HPO_4$ | 0(A) | | | |
| Dry $NaH_2PO_4.H_2O$ | 0(D) | | | |

[1]The percent arsenic removals are calculated based on 49 wppm arsenic in the feed.

The data in the foregoing Table I reveal, among other things, that elemental surfur is itself effective for removing arsenic from raw shale oil, especially at temperatures above 85° C. (185° F.). On the other hand, dry sodium hydrogen phosphates remove essentially no arsenic. Also ineffective for removing arsenic is aqueous trisodium phosphate, a result which contrasts sharply with the roughly 22 to 31 percent removals of arsenic when aqueous sodium hydrogen phosphates are employed. Of most importance, however, are the data relative to the combined use of sulfur and aqueous sodium hydrogen phosphate. Sulfur and aqueous sodium hydrogen phosphate in combination remove, under ambient conditions, over 80 percent of the arsenic—a result comparable to the use of sulfur alone, but at much higher temperatures, i.e., above 85° C. (185° F.).

Of note also, although not tabulated in Table I, are the data obtained in Experiments B, H, and I relative to the sulfur content of the product hydrocarbon. At essentially ambient reaction temperature (Experiment H) and at around 80° C. (176° F.) (Experiment B), the sulfur in the product is only somewhat higher than that in the feed, increasing from 0.963 weight percent to 2.58 weight percent at ambient reaction temperature and to 4.13 weight percent at 80° C. (176° F.). These increases are believed due, at least in part, to the presence of entrained elemental sulfur, which would be removable by a more rigorous separation of solid sulfur from the hydrocarbon product than is possible with the laboratory filtration procedure used in Experiments B and H. On the other hand, the data obtained in Experiment I indicate at the high temperature of reaction used therein—i.e., 150° C. (302° F.)—that substantial hydrocarbon-sulfur reactions occurred, so that the product hydrocarbon had substantially different characteristics with respect to sulfur content. Thus, unless a product hydrocarbon of substantially higher sulfur content than that of the arsenic-containing hydrocarbon feed is desired, the reaction zone temperature when elemental sulfur is employed for arsenic removal should be maintained at a temperature insufficient to effect substantial hydrocarbon-sulfur reactions, e.g., usually below about 250° F. (121° C.) and preferably about 200° F. (93.3° C.).

Although the invention has been described in conjunction with embodiments thereof, including a preferred embodiment, it is apparent that the invention is capable of many modifications, alternatives, and variations. Accordingly, it is intended to embrace within the invention all such modifications, alternatives, and variations as may fall within the spirit and scope of the appended claims.

I claim:

1. A process for reducing the arsenic content of an arsenic-containing hydrocarbon comprising contacting said hydrocarbon with aqueous sodium hydrogen phosphate and removing arsenic components from a product hydrocarbon of reduced arsenic content.

2. A process for reducing the arsenic content of an arsenic-containing hydrocarbon comprising contacting said hydrocarbon with elemental sulfur and aqueous sodium hydrogen phosphate and removing arsenic components from a product hydrocarbon of reduced arsenic content.

3. A process as defined in claim 1 or 2 wherein said arsenic-containing hydrocarbon contains at least 20 wppm arsenic.

4. A process as defined in claim 3 wherein said product hydrocarbon contains less than about 50 percent by weight of the arsenic originally contained in said arsenic-containing hydrocarbon.

5. A process as defined in claim 2 wherein said arsenic-containing hydrocarbon contains at least 20 wppm arsenic and said product hydrocarbon contains less than about 25 percent of the arsenic originally contained in said arsenic-containing hydrocarbon.

6. A process as defined in claim 2 wherein said arsenic-containing hydrocarbon contains at least 2 wppm arsenic.

7. A process for treating an arsenic-containing hydrocarbon derived from shale oil comprising:

(1) admixing elemental sulfur and an aqueous liquid solution containing dissolved sodium hydrogen phosphate with said arsenic-containing hydrocarbon, said hydrocarbon being a full range shale oil or fraction thereof;

(2) separating arsenic components from a product of reduced arsenic content in comparison to said arsenic-containing hydrocarbon; and (3) recovering said product oil of reduced arsenic content.

8. A process as defined in claim 7 wherein the separating in step (2) comprises filtering a solid substance from the admixture produced in step (1) and removing an aqueous phase from the remainder of the admixture.

9. A process as defined in claim 7 wherein said arsenic-containing hydrocarbon is a full range shale oil.

10. A process as defined in claim 7, 8, or 9 wherein said arsenic-containing hydrocarbon contains at least 20 wppm of arsenic.

11. A process as defined in claim 10 wherein said product oil contains less than 50% of the arsenic as was originally contained in said arsenic-containing hydrocarbon.

12. A process as defined in claim 10 wherein said product oil contains less than 25 percent of the arsenic originally contained in said arsenic-containing hydrocarbon.

13. A process for reducing the arsenic content of an arsenic-containing hydrocarbon derived from Colorado oil shale, said arsenic-containing hydrocarbon being either a full range shale oil or a fraction thereof and containing at least about 20 wppm arsenic, said process comprising:

(1) contacting said arsenic-containing hydrocarbon in a reaction zone with elemental sulfur and sodium hydrogen phosphate dissolved in an aqueous medium, said elemental sulfur being introduced into the reaction zone at a rate of 0.01 to 0.50 pound per pound of said arsenic-containing hydrocarbon, and said sodium hydrogen phosphate being introduced in a volumetric ratio to said arsenic-containing hydrocarbon above about 0.1:1.0;

(2) separating arsenic components from a product hydrocarbon of reduced arsenic content in comparison to said arsenic-containing hydrocarbon; and (3) recovering said product hydrocarbon of reduced arsenic content.

14. A process as defined in claim 13 wherein said separating in step (2) yields said arsenic components in admixture with elemental sulfur, and said arsenic components are separated from said elemental sulfur to produce a solid material more concentrated in arsenic than said admixture of arsenic components and elemental sulfur, said separating of arsenic components and elemental sulfur comprising raising the temperature of said admixture above about 260° F.

15. A process as defined in claim 13 wherein said product hydrocarbon has an arsenic content less than about 50 percent of that of said arsenic-containing hydrocarbon.

16. A process as defined in claim 13 wherein said product hydrocarbon has an arsenic content less than about 25 percent of that of said arsenic-containing hydrocarbon.

17. A process as defined in claim 13 wherein said elemental sulfur introduction rate in step (1) is between about 0.05 to 0.35 pounds per pound of arsenic-containing hydrocarbon and said volumetric ratio of said sodium hydrogen phosphate in aqueous medium to said arsenic-containing hydrocarbon is between about 0.5:1.0 and 1.5:1.0.

18. A process as defined in claim 13 wherein said sodium hydrogen phosphate is dissolved in said aqueous medium such that the phosphate concentration thereof is at least 0.10 molar.

19. A process as defined in claim 13 wherein said sodium hydrogen phosphate is dissolved in said aqueous medium such that the phosphate concentration thereof is between about 0.5 and 2.5 molar.

* * * * *